US005987908A

United States Patent [19]

Wetzel

[11] Patent Number: 5,987,908

[45] Date of Patent: Nov. 23, 1999

[54] SELF-CONTAINED AIR CONDITIONER WITH DISCHARGE-AIR FILTER

[75] Inventor: Lawrence E. Wetzel, Cazenovia, N.Y.

[73] Assignee: Floratech Industries, Syracuse, N.Y.

[21] Appl. No.: 09/229,051

[22] Filed: Jan. 11, 1999

Related U.S. Application Data

[62] Division of application No. 08/937,946, Sep. 25, 1997, Pat. No. 5,884,500.

[51] Int. Cl.[6] ..... F25D 23/12

[52] U.S. Cl. ..... 62/259.1; 62/298; 62/DIG. 16

[58] Field of Search ..... 62/259.1, 298, 62/296, 317, DIG. 16

[56] References Cited

U.S. PATENT DOCUMENTS

| | | | |
|---|---|---|---|
| 2,638,757 | 5/1953 | Borgerd | 62/140 |
| 2,920,460 | 1/1960 | Atchison | 62/296 |
| 4,507,940 | 4/1985 | Sato et al. | 62/407 |
| 4,560,395 | 12/1985 | Davis | 55/276 |
| 4,786,300 | 11/1988 | Uesmatsu et al. | 62/259.1 |

FOREIGN PATENT DOCUMENTS

| | | | |
|---|---|---|---|
| 60-226639 | 11/1985 | Japan | 62/DIG. 16 |
| 6-74477 | 8/1992 | Japan | 62/259.1 |

*Primary Examiner*—Henry Bennett
*Assistant Examiner*—Melvin Jones
*Attorney, Agent, or Firm*—Trapani & Molldrem

[57] ABSTRACT

A ceiling or overhead air conditioner unit is configured to fit into a standard space, e.g., two-foot by four-foot, in a dropped ceiling. The unit can be a self-contained air conditioning unit with HEPA filter, or an air conditioner attachment adapted to fit onto a blower and filter assembly. The positions of the condenser air intake and outlet can be field-selected at either the end, the top, or the side, e.g., using a movable plate. The evaporator return inlet can similarly be field-selected at the top, side, or end. The return bypass inlet can be field-selected at the side or top. The room air intake can be connected by a duct either to outside air or to an intake air grille in the ceiling. The air conditioning attachment unit that fits an existing or available ceiling mounted filter and blower assembly has its condenser section on one side of the unit, and its evaporator section at the other side, guiding conditioned air into a centrally situated cool air plenum. Bypass air is supplied to the plenum to mix with the conditioned air. Dampers and ducting permit the environment to be maintained at overpressure or underpressure, as needed for a given application. The unit can be coupled to additional client filter and blower assemblies.

9 Claims, 9 Drawing Sheets

SELF-CONTAINED AIR CONDITIONER WITH DISCHARGE-AIR FILTER

This is a Division of my U.S. Ser. No. 08/937,946, filed Sep. 25, 1997, now U.S. Pat. No. 5,884,500.

BACKGROUND OF THE INVENTION

The invention concerns a ceiling or overhead air conditioner unit that is configured to fit into an available ceiling space, e.g., a two-foot by four-foot dropped ceiling space. The invention is more particularly concerned with a self-contained ceiling mounted unit that has its interior configured so that the inside (evaporator) air and the exhaust heat (condenser) air are moved in separate paths in the unit. The indoor discharge air, conditioned for temperature and humidity, is directed downward through a filter of suitable grade for the application. In some cases, this can be a high-efficiency particulate air (HEPA) filter, and in other applications the filter can be a so-called "absolute" filter, or a chemical-absorptive filter, such as a carbon or carbon-impregnated filter.

Conventional ceiling mounted air conditioner units typically incorporate only the evaporator side of the refrigeration circuit, and employ a separate outdoor condenser unit. This arrangement is referred to as a split system. Conventional ceiling mounted HEPA air filtration units typically involve air handling only, and do not heat or cool the air, nor do they control humidity. While it is sometimes advantageous to create an underpressure in a given space (so that contaminants do not leak out from the space) or to create an overpressure (so that contaminants are forced out, and do not migrate into the space), ceiling mounted self-contained air handling or air conditioning units have not had the capability for either.

There are also several ceiling-mounted filter and blower assemblies available, which are dimensioned to fit into a 2' by 4' ceiling space for providing clean air to a workplace.

Leader et al. U.S. Pat. No. 5,470,363 describes a compact filter and blower assembly with an air intake at the top center of the housing or cabinet, where the intake air encounters a centrifugal blower. A baffle system directs the air downward through a HEPA filter into the room space. The air is not cooled, dehumidified, or otherwise conditioned than by filtering it. Davis U.S. Pat. No. 4,560,395 describes another compact centrifugal fan and blower assembly. Garay et al. Pat. No. 5,053,065 describes a low-profile blower arrangement with a pair of air inlets and twin backward-curved centrifugal impellers. None of these systems employs an air conditioner, either integrated with the blower and filter unit, or piggy-backed onto the unit in the ceiling space.

Candeloro U.S. Pat. No. 5,107,687 is typical of a modular air conditioning system that fits above a suspended ceiling and directs air through channeling in the space above the suspended ceiling. Nelson U.S. Pat. No. 5,152,814 relates to a blower unit for use in isolating patents having contagious respiratory disease. The blower draws air from the patient's room and filters the discharged air to maintain the room at a negative pressure. Again, none of these deals with the problem of providing all the required equipment for conditioning and filtering room air in the geometry of a standard 2' by 4' ceiling space.

The equipment now available or known is not well adapted for ganging units together, either side by side or end to end, and does not provide for field selecting condenser-side intake and outlet at either the end, the side, or the top, as may be required for a given installation.

OBJECTS AND SUMMARY OF THE INVENTION

It is therefore an object of this invention to provide a ceiling mounted air conditioner unit which avoids the drawbacks of the prior art, and which can be completely self-contained, including the condenser section, and which mounts into a standard-ceiling space (e.g., 2' by 4').

It is another object of the invention to provide a ceiling mounted air conditioner unit that can have an incorporated HEPA filter for its discharge air, or can be provided for installation on a separate blower and filter unit.

It is a further object of the invention to provide the ceiling mounted unit with a mixing chamber plenum which can be positioned directly over the blower and filter unit to permit mixing of air that has been cooled and dehumidified with air returned directly from the room space.

It is still another object to provide the air conditioner unit with alternative openings for the air inlet and outlet to permit two or more units to be ganged together either side by side or end to end.

It is still a further object to provide a ceiling mounted server air conditioner unit in which a single air conditioner unit can serve two or more client blower and filter units.

It is another object to have the filter blower built in to the mixing plenum and thereby connected by ductwork to a remote filter unit.

It is a yet further object to provide a ceiling mounted air conditioner unit which can be ducted so as to provide either positive room pressurization or negative room pressurization.

It is yet another object to provide a ceiling mounted air conditioner unit in which room temperature can be controlled either with dampers or with a variable-speed evaporator fan.

A further object of this invention is to provide a ceiling mounted air conditioner unit that can be oriented to allow for once-through, recirculating, positive pressurization, or negative pressurization, as desired, with the same unit.

Still another object is to provide a ceiling mounted air conditioner unit in which the need for condensation plumbing or tubing is avoided.

According to one aspect of this invention, a self-contained air conditioning unit with HEPA filter has a housing or cabinet that is dimensioned to fit into the space of a standard two-foot by four-foot ceiling space, or into a pair of two-foot by two-foot squares, and contains all the necessary refrigeration means (compressor, condenser coil, evaporator coil, and controls) and air handling elements (blowers, filters, motors, baffles, and dampers) so that the unit can provide conditioned, filtered air in a defined local environment. The unit can be used, for example, in a hospital room, a work space, or an area for a sensitive factory operation, e.g., food processing or molded part curing, where the local environment has to meet strict air quality conditions. The conditioned air is diffused through baffles to create a uniform downward flow through the HEPA filter. The unit has a geometry that fits all the parts into the two-foot by four-foot cabinet. The positions of the condenser side intake and outlet can be field-selected at either the end, the top, or the side. Here, a plate can be moved from one port to the other at the corner during installation. This configuration also permits additional units to be ganged together, either end-to-end, side-to-end, or side-by-side. The room air intake can be connected by a duct either to outside air or to an intake air grille in the ceiling. The condenser-side air can be either the air in the space above the ceiling, the air in the room space, or outside air. In the latter case, suitable ductwork can be easily connected to the unit and communicate with the outside environment. Optionally, ducts can be provided to connect the indoor space with the intake to the condenser air to create an underpressure, or to connect outdoor make-up air to the room return air (evaporator) intake to create an overpressure condition. As a further option, a UV lamp within the unit sterilizes the indoor air before it is discharged. Condensed water from the evaporator is collected in a drain pan, and is passed into a pan on the condenser side. There, hot gas in the compressor-condenser tube heats the condensate water, and the water vapor is discharged with the air leaving the condenser coil. This avoids the need to pipe away condensate.

According to another embodiment of the invention, an air conditioning unit is adapted to mate onto an existing or available ceiling mounted filter and blower assembly. In this case the unit has a condenser section on one side of the unit housing, and an evaporator section in which intake (return) air is guided through an evaporator coil into a central cool air plenum, from whence the air is supplied to the intake of the filter and blower assembly. The plenum is also supplied with bypass (unconditioned) room air, so that the conditioned air is mixed with the bypass room air. By the use of dampers and ducting, the room air can be maintained at an overpressure, or at an underpressure, as needed for a given application. The conditioned air can also be supplied, e.g., through a conduit, to one or more additional client filter and blower assemblies.

The above and many other objects, features, and advantages of this invention will become apparent from the ensuing detailed description of a few of many possible preferred embodiments, which description should be read in conjunction with the accompanying Drawing.

DESCRIPTION OF THE PREFERRED EMBODIMENT

Figure 1:
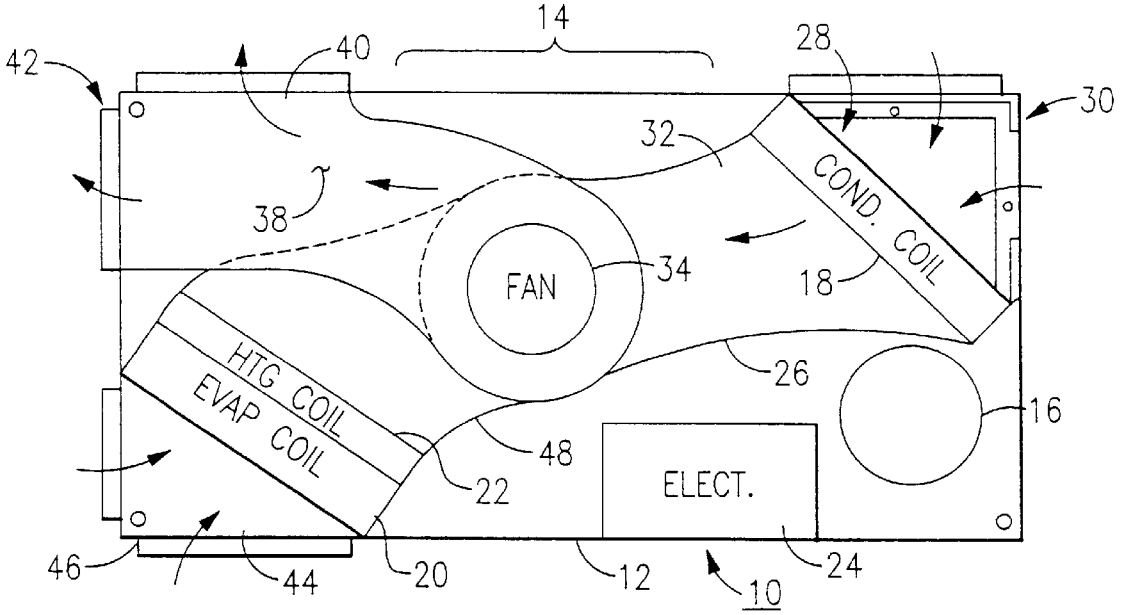
FIG. 1 is a top plan view of a fully integrated self-contained ceiling mounted air conditioning unit according to one embodiment of this invention.
Figure 2:
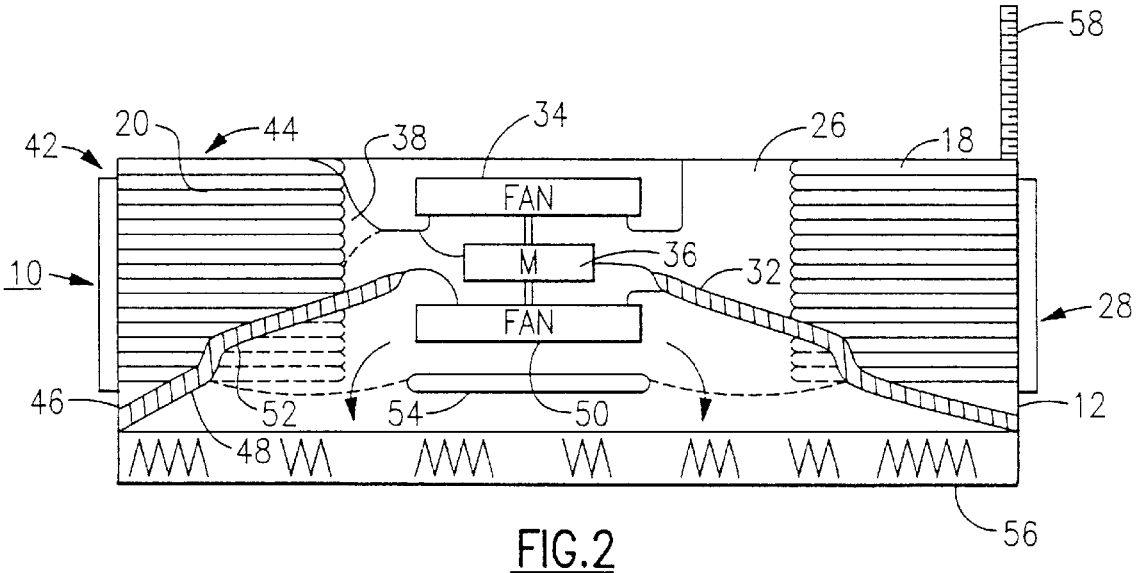
FIG. 2 is an elevational sectional view of the unit of this embodiment.

With reference to the Drawing figures, a self-contained ceiling mounted air conditioner and HEPA unit 10 according to one embodiment of this invention is shown in FIGS. 1 and 2. This unit is fully integrated and self-contained, except for any required ducting. The unit 10 has a case or cabinet 12 with a nominal twenty-four inch by forty-eight inch plan so that its footprint matches that of a standard ceiling space, and fits into standard T-bar construction. This permits the unit 10 to be easily installed in the ceiling space above a work area. The height of the cabinet 12 depends on the capacity of the unit, but in one typical example, with a refrigeration capacity of one-half ton to one ton and an air handling capacity of 800 cfm, the cabinet has a height of about eighteen inches. To accommodate a larger capacity, the height could be twenty-four inches, or higher for some applications.

The unit 10 has a refrigeration circuit or a/c coolant circuit 14, which can be based on a standard modem refrigerant. This includes a compressor 16, a condenser coil 18, an evaporator coil 20, and an optional re-heat coil 22, e.g., for humidity control. An electrical box 24 within the cabinet 12 contains electric power controls, thermostat and humidity controls, timers, and other known electrical elements. Piping and tubing from one element to the next is not shown here.

An exhaust air circuit 26 includes an inlet port 28, located at one corner 30 of the cabinet, or on top, with a condenser air baffle 32 defining a path for air through the condenser coil 18 to a condenser fan or blower 34. Here the blower is a centrifugal fan driven by a fan motor 36. An exhaust baffle 38 defines an exhaust air path that leads to an exhaust outlet port 40. This port is disposed at a second corner 42 of the cabinet, or on top. Each of the inlet and outlet ports can be configured for intake or discharge to the side or to the end of the cabinet, or on top, and this is accomplished simply by installing duct work, as appropriate, in the desired orientation, and by blocking the other orientation with a suitable reversible plate that is provided with the unit. This feature allows the installer to tailor the unit to the specific application without having to modify the unit itself in any way.

As to the conditioned air for the controlled clean space or work space, an indoor-air return air intake port 44 is disposed at a third corner 46 or top of the cabinet, and is configured to permit return air to be accepted either from the end, from the side, or from the top. A return air baffle 48 defines an air path through the evaporator 20 (and as appropriate, through the reheat coil 22) and thence to the intake side of an evaporator fan or blower 50. In this embodiment, the fan 50 is a centrifugal fan, also driven by the fan motor 36. The air at the leaving side of the fan 50 goes to a discharge air baffle 52, which diffuses the discharge air and turns it downwards, while another discharge baffle 54 beneath the fan 50 blocks a line of sight from the fan, minimizing fan noise and facilitating diffusion of the discharge air.

Beneath the fan 50 and baffles 52, 54 is a HEPA filter 56, through which the discharge air passes as it is discharged into the space beneath. The air passes vertically downwards through the filter 56. Optionally, there is also a coarse pre-filter on the return-air side of the evaporator coil 20 and a similar filter in advance of the condenser coil 18. In addition, an optional ultraviolet lamp can be installed above the HEPA filter 56. In some cases, suitable baffling can be installed to block the line of sight from the lamp to the filter. However, it has been found that the HEPA filter 56 is sufficiently opaque to ultraviolet that no baffling is needed. The ultraviolet light thus bathes the filter, and kills any contaminant bacteria, virus or fungi. A fluorescent lighting fixture can be added beneath the HEPA filter 56 for general purpose illumination.

As shown in FIG. 2, hanger supports 58 can be included with the unit to facilitate mounting in the space above the drop ceiling. These can be threaded rods, for example. The hanger supports 58 also can provide earthquake protection. Also shown here are flanges and tabs at the various intake and discharge ports to facilitate connection of ductwork, pre-filters, or dampers.

Figure 3:
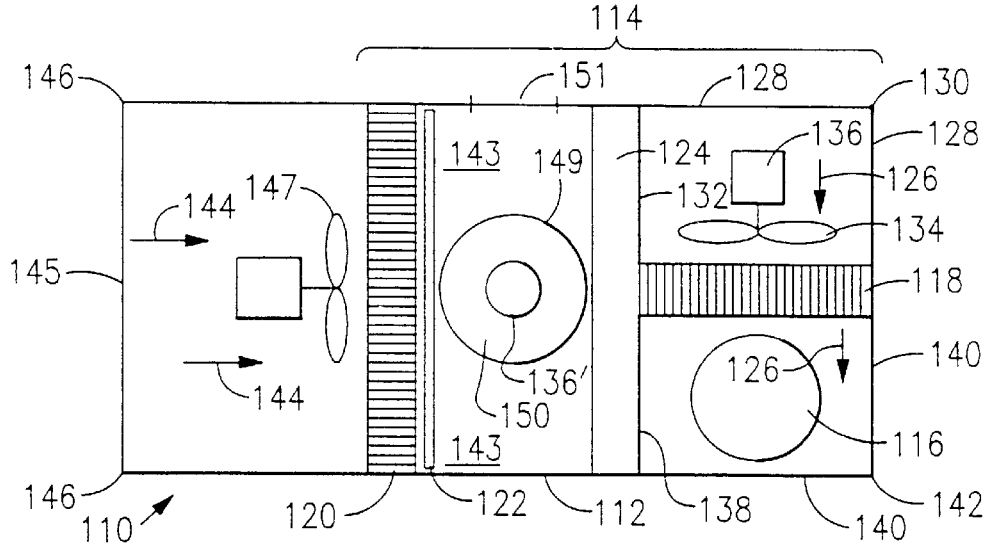
FIG. 3 is a top plan view of a combination blower and filter unit and air conditioner attachment unit for the blower and filter unit, according to another embodiment of this invention.
Figure 4:
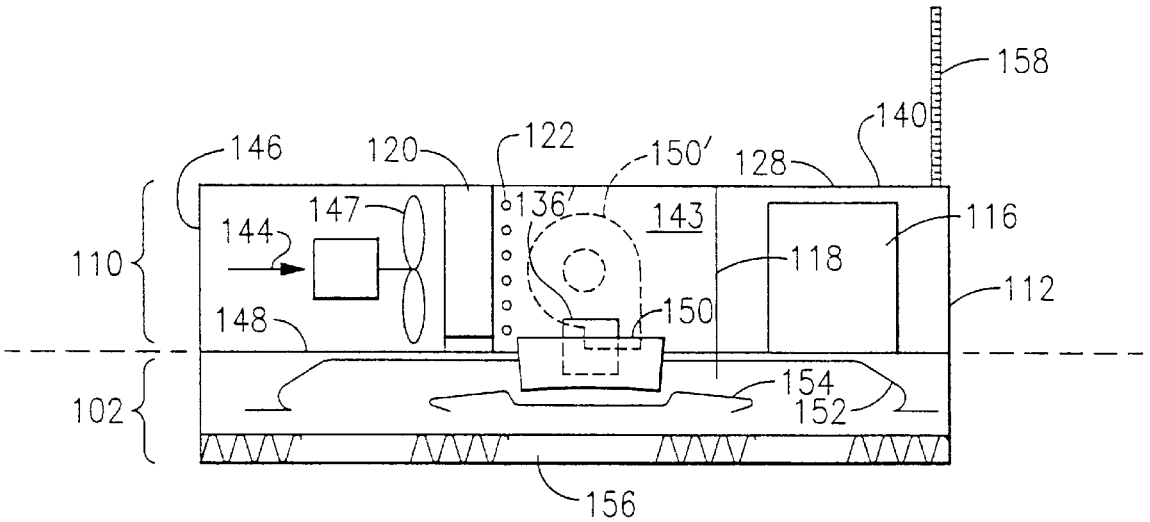
FIG. 4 is an elevational sectional view of the attachment unit of this invention atop a blower and filter unit.

A ceiling mounted air conditioner attachment unit 110 of a second embodiment is shown in FIGS. 3 and 4. This unit can be employed with a separate, air blower and filter assembly 102, e.g., of the type which is described in U.S. Pat. Nos. 5,470,563; 4,560,395; or 5,053,065. Here, elements that correspond to elements employed in the first embodiment are identified with similar reference numbers, but raised by 100.

As mentioned previously, these blower and filter assemblies are designed to fit into a standard 2' by 4' ceiling space. The blower and filter assembly 102 takes intake air from the space above a suspended ceiling and forces it downwards through a HEPA filter or other similar filter to provide clean, i.e., filtered, air to a work space directly beneath the assembly 102. These assemblies do not treat the air other than by filtration. There is no means included in the blower and filter assembly to carry out temperature or humidity control, and no means to create an overpressure or underpressure in the work space environment.

Here, a ceiling mounted air conditioner attachment unit 110 is provided with a case or enclosure 112 of a standard 2' by 4' profile or footprint. The air conditioner attachment unit 110 is fastened or attached atop the assembly 102. The unit 110 can be suspended from the structural ceiling by means of threaded rods or other similar hanger means, and the blower and filter assembly 102 can be suspended from the unit 110.

As in the first embodiment, the attachment unit 110 has a refrigerant circuit or a/c coolant circuit 114, including a compressor 116, a condenser coil 118, an evaporator coil 120 (here, with optional reheat coil 122), and an electrical equipment box 124 that contains the usual timers and controls. The power for the assembly 102 may also be taken off from the equipment box 124.

Here, a condenser air path 126 is oriented generally transversely at one end of the cabinet 112, with an intake 128 on one side wall of the enclosure, and with the condenser coil 118 disposed across this transverse path. The condenser fan or blower 134 directs air through the coil 118 and out through an exhaust air port 140. The intake 128 can be on the end, side or the top, and the exhaust air port 140 can likewise be on the end, side, or top. The positions of the condenser air intake and outlet air for the condenser air as well as the return air port can be field-selected at the top, end, or side, e.g., by using a movable plate or the like. There can be ductwork for conveying the air to and from this circuit 126, but that is omitted in these views.

A wall or partition 138 closes off the condenser air circuit 126 from a conditioned air plenum 143 situated at the middle of the air conditioner attachment unit 110, considered along its lengthwise axis. This partition 138 can have an insulated layer to serve as a heat barrier.

Starting at the other end of the air conditioner attachment 110 is a conditioned air path 144 that proceeds through an air intake port 145 disposed in an end wall 146 of the enclosure 112. Alternatively, this port can be in a top or side wall. An evaporator fan 147 directs air through the evaporator coil 120 into the plenum 143. The optional reheat coil 122 can be positioned downstream of the coil 120. Alternatively, a resistive heater element can be employed instead of the reheat coil 122.

In the centrally located plenum 143, a bottom wall 148 has a central aperture 149. This aperture serves to supply air to the blower and filter assembly 102, which filters the conditioned air and discharges same into the work space. Here, as shown in FIG. 4, the assembly 102 has a centrifugal blower 150 (with associated motor 136') mounted centrally at its top, with baffles 152, 154 and HEPA filter 156, to distribute and filter the air leaving the plenum 143. At the plenum 143, the enclosure 112 of the air conditioner assembly 110 can have a return air port 151 for admitting bypass air from the room directly to the plenum, so that the plenum 143 contains a portion of conditioned air and a portion of bypass air. The relative amounts of conditioned and bypass air can be controlled by adjusting baffles, or by adjusting the relative speeds of the fan 147 and blower 150. In one general example, there is about 200 cfm of airflow through the evaporator, and about 600 cfm of bypass airflow, for a combined 800 cfm of air leaving the plenum 143. The bypass return air port 151 can be positioned at the top or at the side of the housing, as determined at installation, by means of a movable plate, for example. Also, there may be an additional fan-like blower 150' positioned within the plenum or mixing chamber 143, or this fan may entirely take the place of the blower 150. This permits the ceiling unit to be used with filter units that do not have an incorporated fan or blower.

As in the first embodiment, ultraviolet sterilizing lamps can be disposed above the filter 156, and fluorescent lamps for general illumination can be disposed beneath the filter 156.

Figure 5:
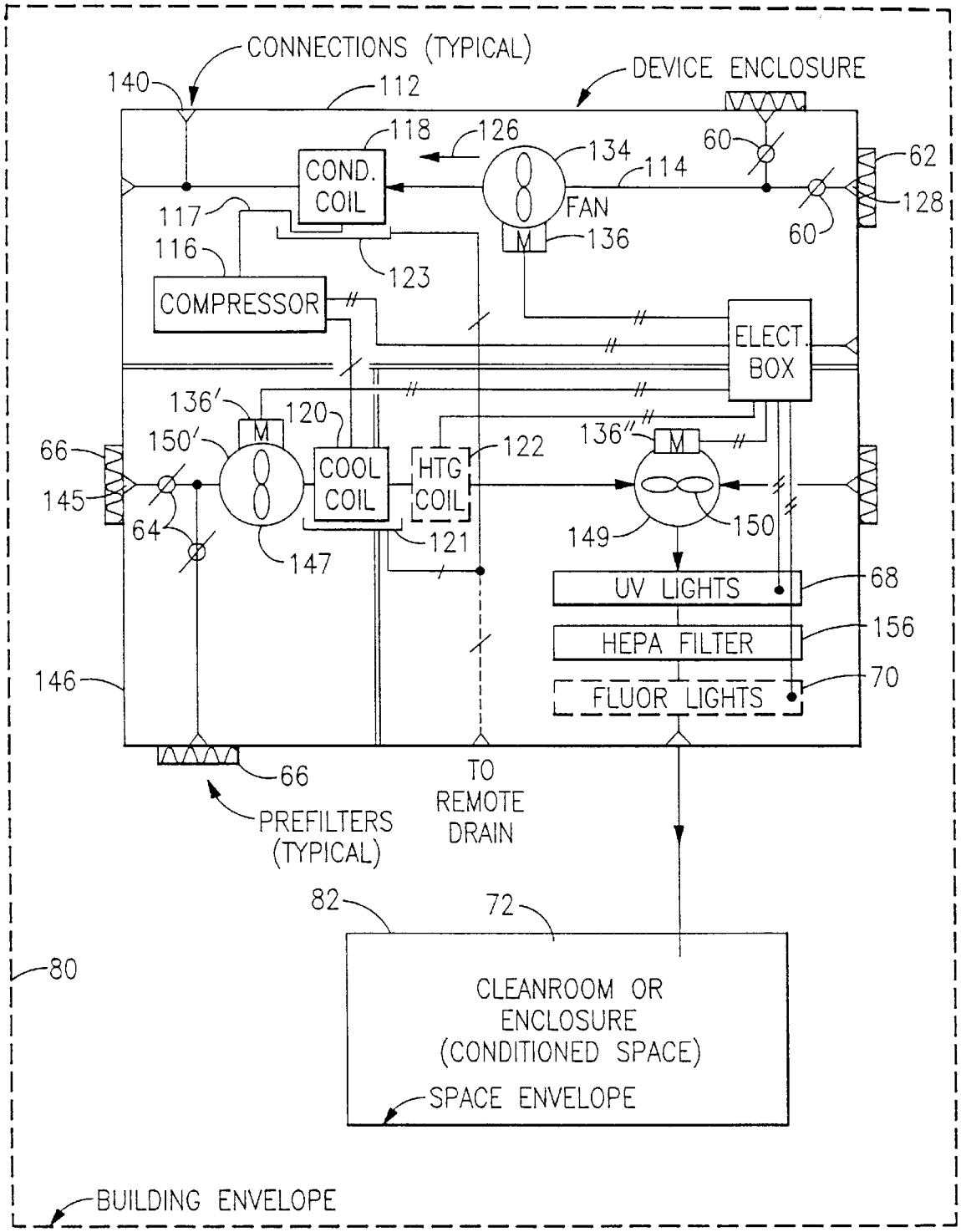
FIG. 5 is a schematic view of the unit of this embodiment employed above a clean room or enclosure space.

FIG. 5 shows a general schematic of the blower and filter assembly 102 and the air conditioner attachment 110, for which elements that have been previously identified in FIGS. 3 and 4 are again identified with the same reference numbers.

Figure 6:
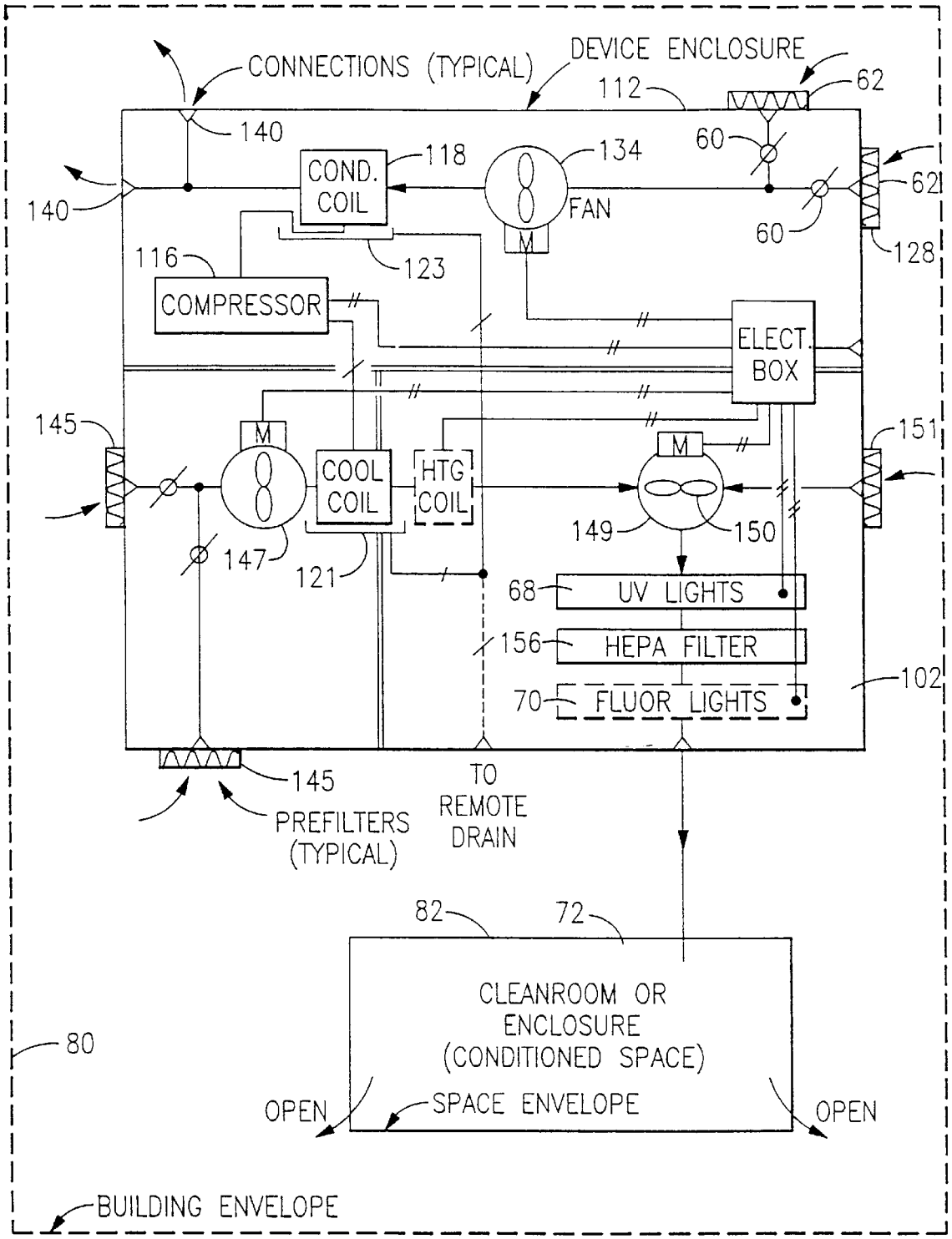
FIG. 6 is a schematic view of the unit of this embodiment configured for a once-through application.

Here, at the condenser air intake 128 there are dampers 60 for airflow control, and a pre-filter 62 in advance of the blower 134 and condenser coil 118. At the return airport 145 there are dampers 64 provided for airflow control, and a coarse filter 66 in advance of the cooling coil or evaporator coil 120. A drip pan 121 is here shown beneath the coil 120, with conduit to carry condensed moisture to a pan 123 in the condenser air path 126. There, a hot gas tube that carries compressed refrigerant from the compressor 116 to the condenser coil 118 passes through the pan 123 to evaporate the condensate. The resulting water vapor is-carried away with the exhaust air back into the outside environment. Consequently, no drain is required, and the need for plumbing or drain tubing is eliminated. Following the indoor side fan or blower 150, are shown optional UV lamp(s) 68, the HEPA filter 156, and optional fluorescent fixture 70. FIG. 6 shows schematically a once-through application, in which fresh air is continuously brought through, conditioned, and then permitted to leave the conditioned environment. Here, the exhaust heat air inlet 128 and outlet 140 can be connected to suitable ductwork or exposed to the ambient, and the return air inlet port 145 can be open to the space above the drop ceiling. The conditioned and filtered air is discharged through the filter 156 into a clean space or enclosure 72, and the air is then permitted to leave the conditioned space 72 through openings in the clean space envelope 82. Air leaves this space 72 by way of the usual leaks, cracks, and penetrations occurring in the envelope 82. The overall building space has an envelope 80, shown here schematically.

Figure 7:
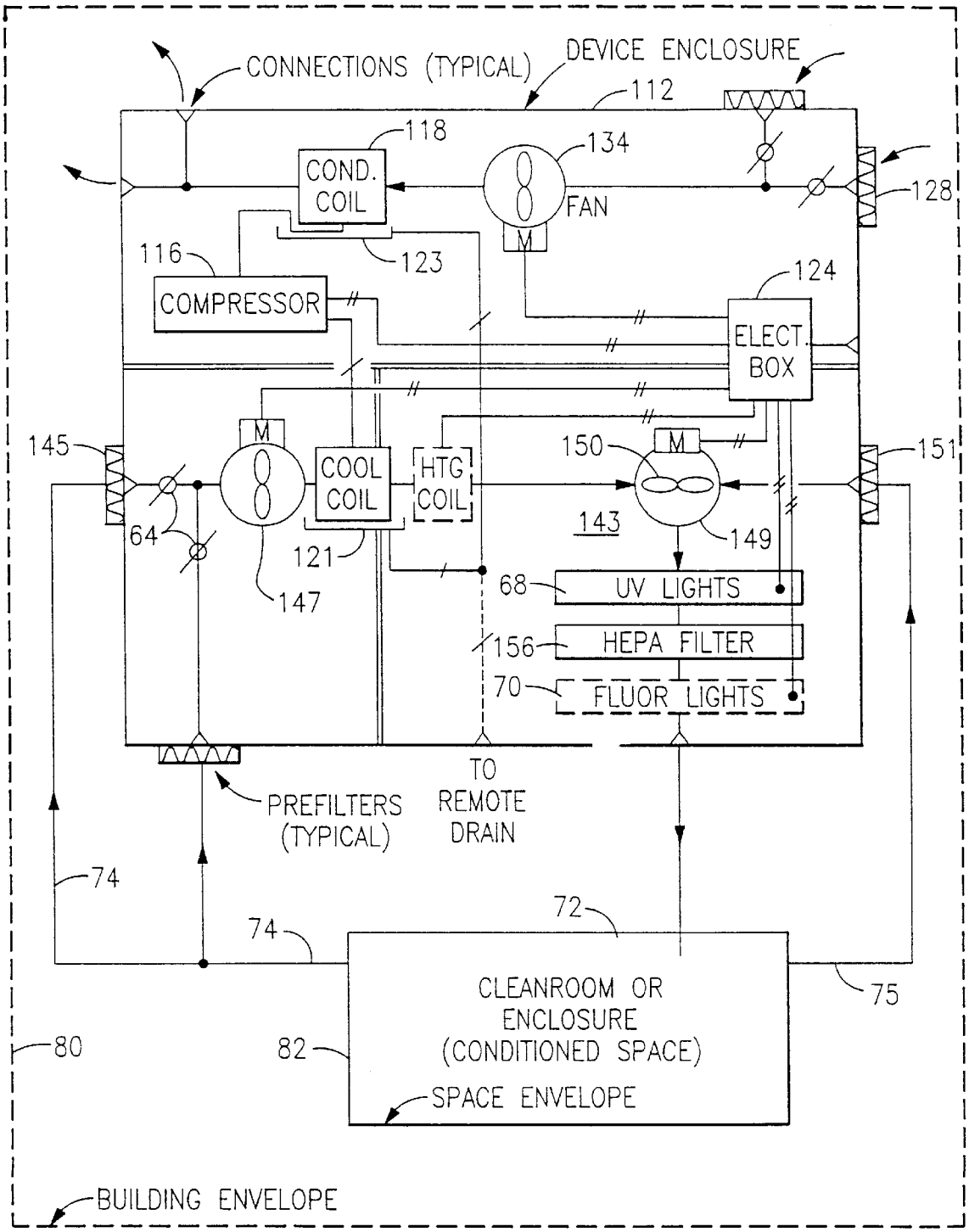
FIG. 7 is a schematic view of the unit of this embodiment configured for a recirculating application.

FIG. 7 shows a recirculating application of the combination 110, 102. In this configuration there are one or more return air ducts 74 leading from the envelope 82 of the clean space or enclosure 72 to the port(s) 145. A bypass air duct 75 brings air from the space 82 through the bypass port 151 into the plenum 143. The dampers 64 are adjusted to achieve a desired air flow. A portion of the conditioned air that discharges into the space 72 is recirculated through the evaporator 120, fan 150 and filter 156.

Figure 8:
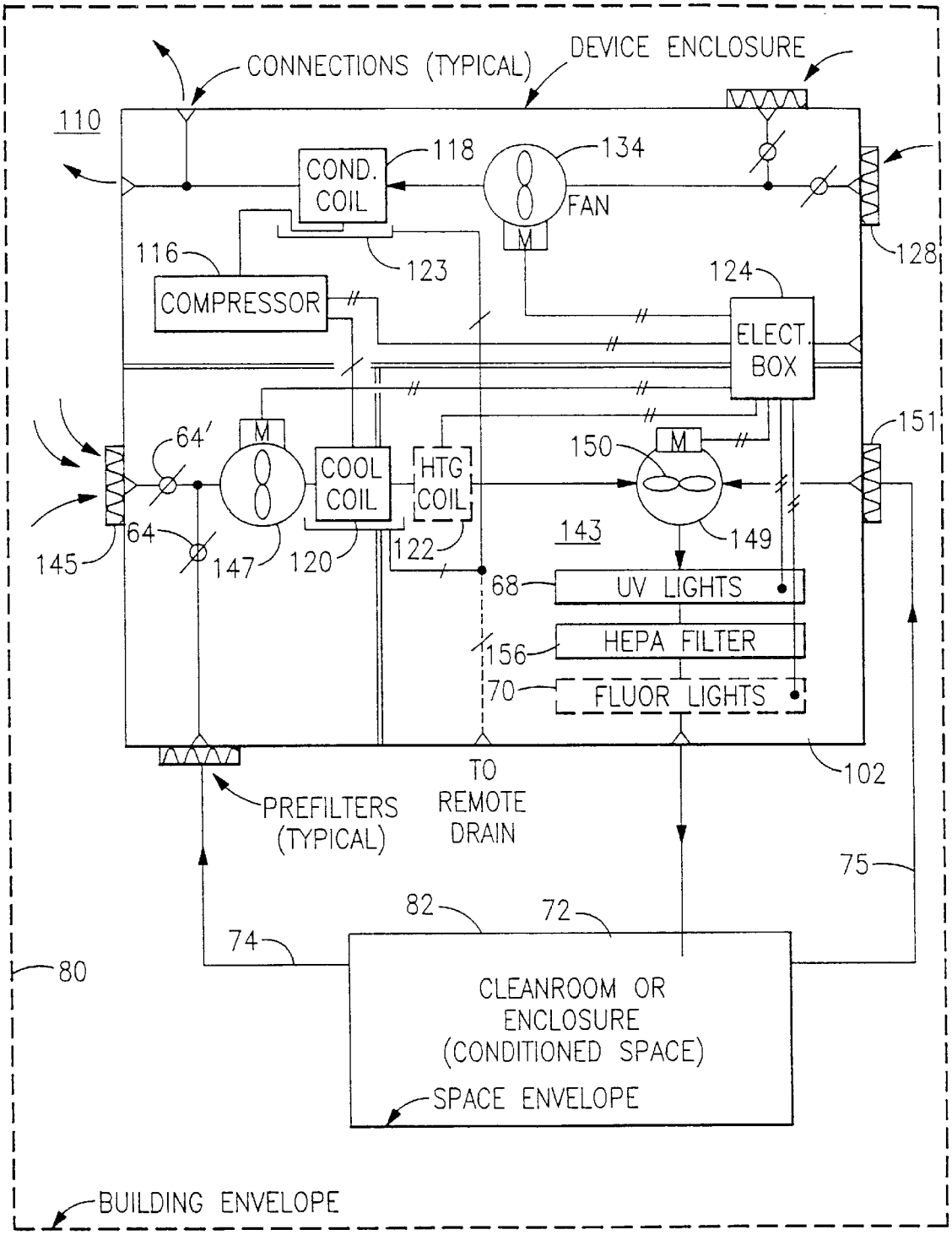
FIG. 8 is a schematic view of the unit of this embodiment configured for a positive (overpressure) application.

FIG. 8 shows a positive pressure application of the combination 110, 102, in which a controlled overpressure is maintained in the conditioned space 72. Here, the return air port 145 is split, being supplied both with return air through the duct 74 and with outside makeup air. One damper 64 is assigned to the return air from the space 72, and another damper 64' is assigned to control the outside, make up air. The return air flow creates a low pressure area at this point, so that additional make-up air continues to enter the air flow. This creates and maintains a small overpressure in the space 72, so that any air movement across the space envelope 82 is to discharge the air from the space.

Figure 9:
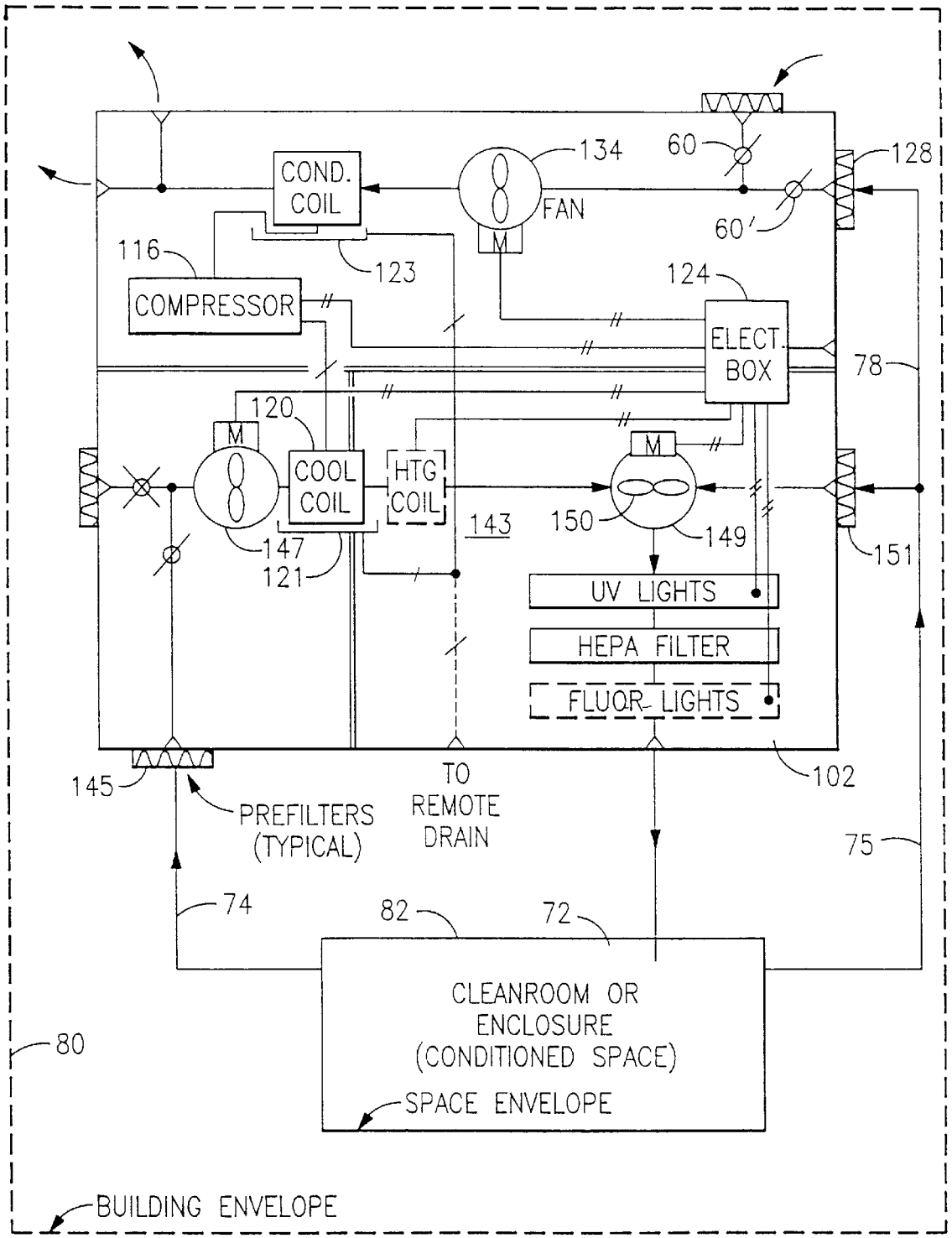
FIG. 9 is a schematic view of the unit of this embodiment configured for a negative (underpressure) application.

FIG. 9 shows a negative pressure application of the combination 110, 102, in which a controlled underpressure is maintained in the conditioned space 72. Here, the return air port 145 is connected to the return air duct 74, but is closed to outside make-up air. Another duct 78 connects the space 72 to the exhaust air inlet 128, which is here split between outside air and the indoor air from this duct 78. One damper 60 is assigned to control flow of the outside air through the exhaust air circuit 126, and another damper 60' is assigned to control flow of the indoor air from the duct 78. The air pressure at this point is somewhat reduced, which causes a small pressure reduction in the clean space 72. This means that air flow, together with any entrained contaminants, will be in the direction across the space envelope 82 into the clean environment and into the filter 156. This is sometimes useful in containing any contaminants, toxins, or bacteria.

Figure 10:
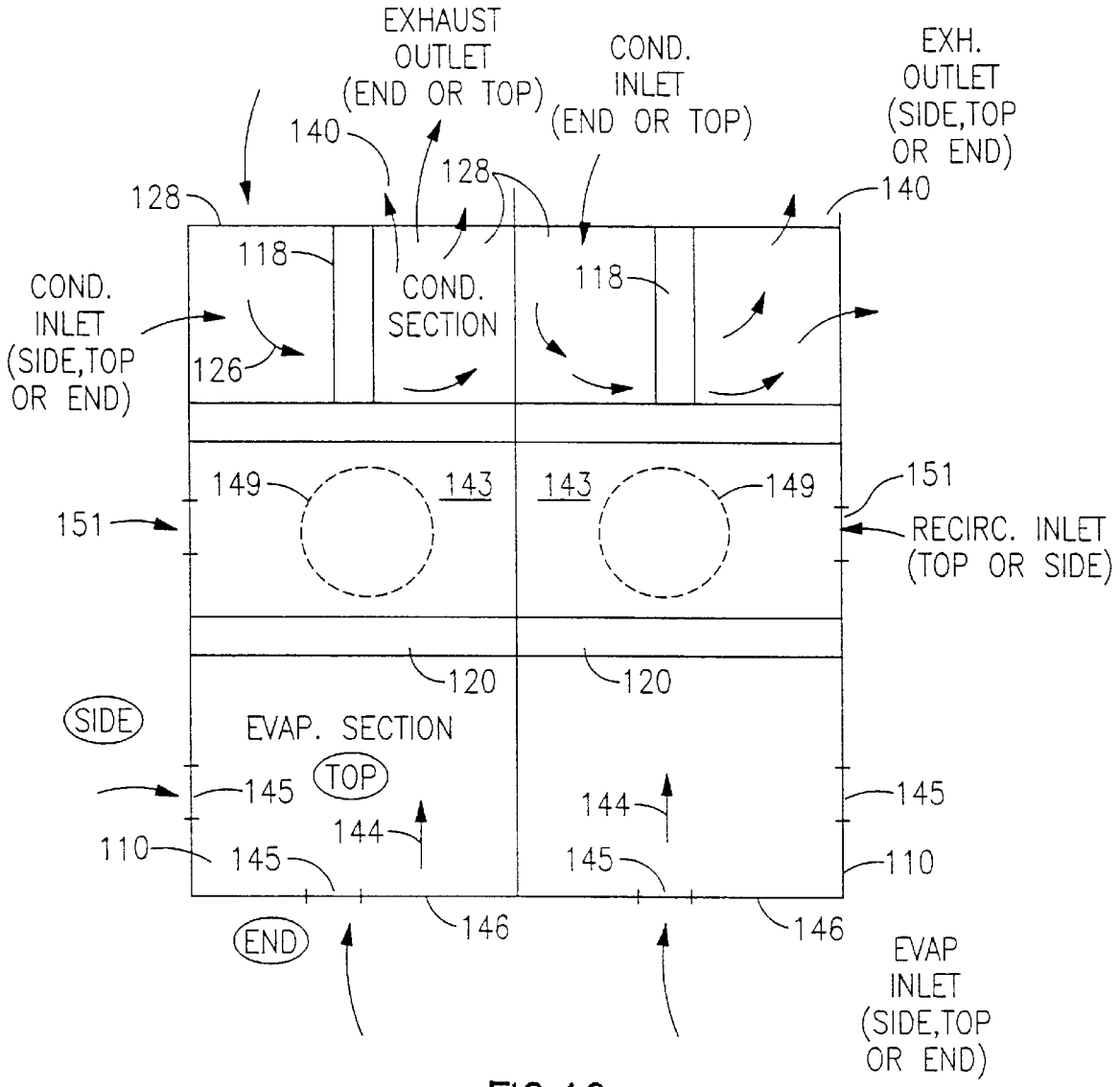
FIG. 10 is a schematic plan view showing a pair of these units ganged together.

As previously mentioned, a pair of these ceiling mounted air conditioner attachment units 110, or a larger group of these units, can be ganged together to occupy adjacent ceiling squares, e.g., a four-foot by four-foot space. One such configuration is shown in plan in FIG. 10. Here, there are two units, and these have identical construction so that they can be connected side by side. In this view the exhaust air inlet ports 128, 128 can joined to a common duct (not shown) and both exhaust outlets 140 can likewise be connected to a common exhaust air duct (not shown). Because the intake and discharge ports can be at the top, side, or end, there is always access to the supply and return ducts, even when the two units are adjacent or butted. These two ceiling-mounted attachments can have separate independent controls, or alternatively can be configured as master-slave or as server-client.

Figure 11:
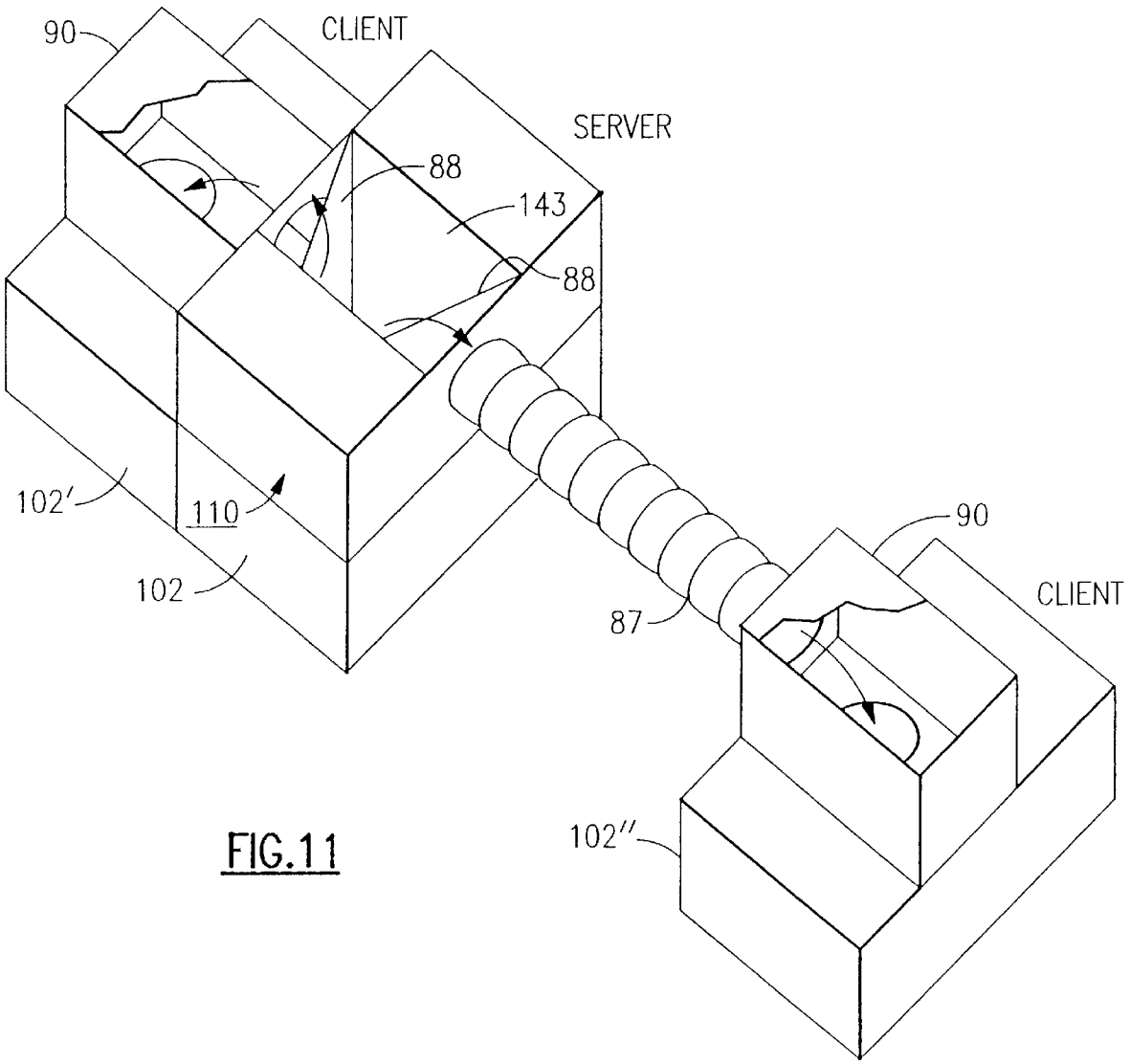
FIG. 11 is a schematic perspective view of a server-multiple client arrangement of the unit of this invention.

A further arrangement, here server-client, is shown in FIG. 11, in which a single air conditioner attachment 110 is configured as server to supply conditioned air to three client blower and filter assemblies including a unit 102 on which it is mounted, a second unit 102' butted against the first unit 102, and a third unit 102" that is separated from the unit 102, but is connected to the plenum 143 of the server air conditioner attachment 110 by means of ductwork 87. Here, the cover or top wall of the attachment 110 is removed to show a set of diverter plates or baffles 88 within the plenum 143. These baffles 88 are configured to divert a portion of the air to each of the client blower and filter assembly units 102' and 102", respectively. Also shown here are adapter boxes 90 on the respective units 102' and 102" to direct air to their respective blowers 150' and 150". These can be sheet metal boxes, or can be tubular adapters, as needed to fit the intake openings of the respective assembly 102. There can be pre-filters positioned in each of the two client unit adapter boxes 90, if desired. Bypass air can be provided separately to each of the three units, or there can be a common bypass air duct provided.

The conditioned space can be a separate room or enclosure, or a zone within a room or an area defined by curtains or room dividers, with or without a frame or stand, as appropriate.

While the ceiling mounted self-contained air conditioner of this invention has been described in detail with reference to certain preferred embodiments, it should be understood that the invention is not limited to those precise embodiments. Rather many modifications and variations will present themselves to persons of skill in the art without departing from the scope and spirit of this invention, as defined in the appended claims.

I claim:

1. A self-contained ceiling mounted air conditioner and filtering unit comprising a housing dimensioned to fit into a standard ceiling space, and having an upper wail, first and second end walls, and first and second side walls; a refrigeration circuit comprising a compressor, a condenser coil, and an evaporator coil; an exhaust air circuit including an inlet port in said housing, an air path through said condenser coil, an exhaust outlet port in said housing, and a condenser fan forcing air through said condenser towards said outlet; a conditioned air circuit including a return air intake port on said housing, an air path passing through said evaporator coil to a conditioned air plenum, and an evaporator fan moving said air through said evaporator coil to said plenum; baffle means below said plenum for directing air from said plenum generally downward; and filter means in said conditioned air circuit after said plenum for removing particulates from said conditioned air.

2. The self-contained ceiling mounted air conditioner and filtering unit of claim 1 wherein said evaporator fan includes a centrifugal fan disposed downstream of said evaporator coil.

3. The self-contained ceiling mounted air conditioner and filtering unit of claim 2 wherein said refrigeration circuit has a cooling capacity of about one-half ton to one ton.

4. The self-contained ceiling mounted air conditioner and filtering unit of claim 3 wherein there is an airflow of about 800 cfm through said plenum and said filter means.

5. The self-contained ceiling mounted air conditioner and filtering unit of claim 1 wherein said housing has a nominal twenty-four by fourty-eight inch plan so that its footprint matches that of a standard two-foot by four-foot ceiling space.

6. The self-contained ceiling mounted air conditioner and filtering unit of claim 1 wherein the return air intake port is configured as a plurality of ports located at a corner of the housing, and further comprising one or more adjustable baffles which can be field-configured to duct return air into a side, an end, or a top of said housing.

7. The self-contained ceiling mounted air conditioner and filtering unit of claim 1 wherein each of said inlet port and said exhaust outlet port is configured as a plurality of ports located at a respective corner of said housing, and further comprising respective adjustable baffles which can be field configured to duct condenser intake air into a side, end, or top of said housing and to duct condenser exhaust air out from a side, end, or top of said housing.

8. The self-contained ceiling mounted air conditioner and filtering unit of claim 1 wherein said baffle means includes a discharge baffle beneath said evaporator fan blocking a line of sight from the evaporator fan, thereby minimizing fan noise.

9. The self-contained ceiling mounted air conditioner and filtering unit of claim 1 further comprising threaded rod hanger means for suspending said unit from building structure above said unit.

* * * * *

UNITED STATES PATENT AND TRADEMARK OFFICE

CERTIFICATE OF CORRECTION

PATENT NO. : 5,987,908

DATED : November 23, 1999

INVENTOR(S) : Lawrence E. Wetzel

It is certified that error appears in the above-identified patent and that said Letters Patent is hereby corrected as shown below:

In Col. 8, Line 24:

"wail" should read --wall--.

Signed and Sealed this

Twenty-seventh Day of June, 2000

*Attest:*

*Attesting Officer*

Q. TODD DICKINSON

*Director of Patents and Trademarks*